US007020933B2

(12) United States Patent
Chang

(10) Patent No.: US 7,020,933 B2
(45) Date of Patent: Apr. 4, 2006

(54) CONNECTOR DEVICE FOR SUSPENDING STRAPS

(76) Inventor: Vincent Chang, P.O.Box 63-298, Taichung (TW) 406

( * ) Notice: Subject to any disclaimer, the term of this patent is extended or adjusted under 35 U.S.C. 154(b) by 85 days.

(21) Appl. No.: 10/877,223

(22) Filed: Jun. 25, 2004

(65) Prior Publication Data

US 2005/0283951 A1 Dec. 29, 2005

(51) Int. Cl.
*B25B 25/00* (2006.01)
*A44B 11/02* (2006.01)

(52) U.S. Cl. ..... 24/68 CD; 24/68 R; 24/68 E

(58) Field of Classification Search ..... 24/68 CD, 24/269, 69 ST, 68 T, 68 E, 71 ST, 69 CT, 24/302

See application file for complete search history.

(56) References Cited

U.S. PATENT DOCUMENTS 3,133,329 A 5/1964 Gaylord
4,507,829 A * 4/1985 Looker ..... 24/68 CD
4,751,770 A * 6/1988 Kawahara ..... 24/68 CD
4,987,653 A * 1/1991 Lin ..... 24/68 CD
6,158,092 A * 12/2000 Huang ..... 24/68 CD
6,499,197 B1 * 12/2002 Huang ..... 24/68 CD
6,615,456 B1 * 9/2003 Huang ..... 24/68 CD
6,631,537 B1 * 10/2003 Huang ..... 24/193
2003/0131451 A1 * 7/2003 Brown ..... 24/68 CD

* cited by examiner

*Primary Examiner*—Robert J. Sandy
(74) *Attorney, Agent, or Firm*—Charles E. Baxley

(57) ABSTRACT

A connector device includes a base coupled to a strap and having a chamber formed between two side panels and having a curved slot formed in each of the side panels. A connector frame is rotatably secured to the base with an axle, a shaft is attached to the frame and slidably engaged in the curved slots of the side panels of the base, to guide the shaft to slide in the curved slots of the base. A latch is slidably attached to the frame to selectively lock the frame to the base. Another strap has an intermediate segment engaged over the shaft and engaged around the axle, and may be selectively tightened by the shaft.

7 Claims, 6 Drawing Sheets

CONNECTOR DEVICE FOR SUSPENDING STRAPS

BACKGROUND OF THE INVENTION

1. Field of the Invention

The present invention relates to a connector device, and more particularly to a connector device for coupling or for suspending straps.

2. Description of the Prior Art

Typical connector devices for coupling or for suspending straps have been developed for coupling two straps together, and comprises a ring or loop for attaching or coupling to a lock device, and the straps are coupled to the loop and the lock device respectively, for allowing the straps to be coupled together by engaging the loop toward the lock device.

For example, U.S. Pat. No. 3,133,329 to Gaylord discloses one of the typical connector devices comprising a strap ring coupled to one of the straps, and a connector frame couple to the other strap, and the strap ring may be attached to the connector frame, and may be selectively locked to the connector frame with a swinging member and a tumbler.

However, the strap ring may only be coupled and secured to the lock device with the swinging member and the tumbler, but may not be used to straighten or tighten the straps, such that the length of the straps should be cut to the required or predetermined length before attaching to the strap ring and the lock device, and such that the straps may not be easily and quickly tightened and secured together.

The present invention has arisen to mitigate and/or obviate the afore-described disadvantages of the conventional connector devices.

SUMMARY OF THE INVENTION

The primary objective of the present invention is to provide a connector device for allowing two straps to be easily and quickly tightened together.

In accordance with one aspect of the invention, there is provided a connector device comprising a base including a chamber formed therein and defined between two side panels and a bottom panel, each of the side panels including a curved slot formed therein, the base including at least one lock notch formed therein, an axle straddled between the side panels of the base, a first strap attached to the base, a connector frame received in the chamber of the base, and rotatably secured to the base with the axle, a shaft attached to the frame and slidably engaged in the curved slots of the side panels of the base, to guide and to limit a sliding movement of the shaft in the curved slots of the base, and to limit a rotational movement of the frame relative to the base, a latch slidably attached to the frame, and engageable with the lock notch of the base, to selectively lock the frame to the base, and a second strap including an intermediate segment engaged over the shaft and engaged around the axle. The shaft is engageable with the intermediate segment of the second strap, to force and to tighten the second strap when the frame is moved toward the base and locked to the base at a locking position with the latch, and the shaft may release the intermediate segment of the second strap when the frame is rotated away from the base at a released position.

The frame includes two side plates each having a groove formed therein, and the latch includes two side catches extended therefrom and slidably engaged through the grooves of the side plates of the frame, to guide the latch to slide relative to the frame.

The frame includes an ear having an aperture formed therein, and the latch includes an extension extended therefrom and slidably engaged through the aperture of the ear of the frame, to guide the latch to slide relative to the frame.

The frame includes an opening formed therein, and the latch includes at least one hand grip extended therefrom and extended outwardly through the opening of the frame, to allow the latch to be moved relative to the frame with the hand grip.

The frame includes a spring engaged between the frame and the latch for biasing the latch to engage with the lock notch of the base.

The base includes a passage formed therein, the first strap is engaged through the passage of the base and coupled to the base, and/or the second strap may also be engaged through the passage of the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
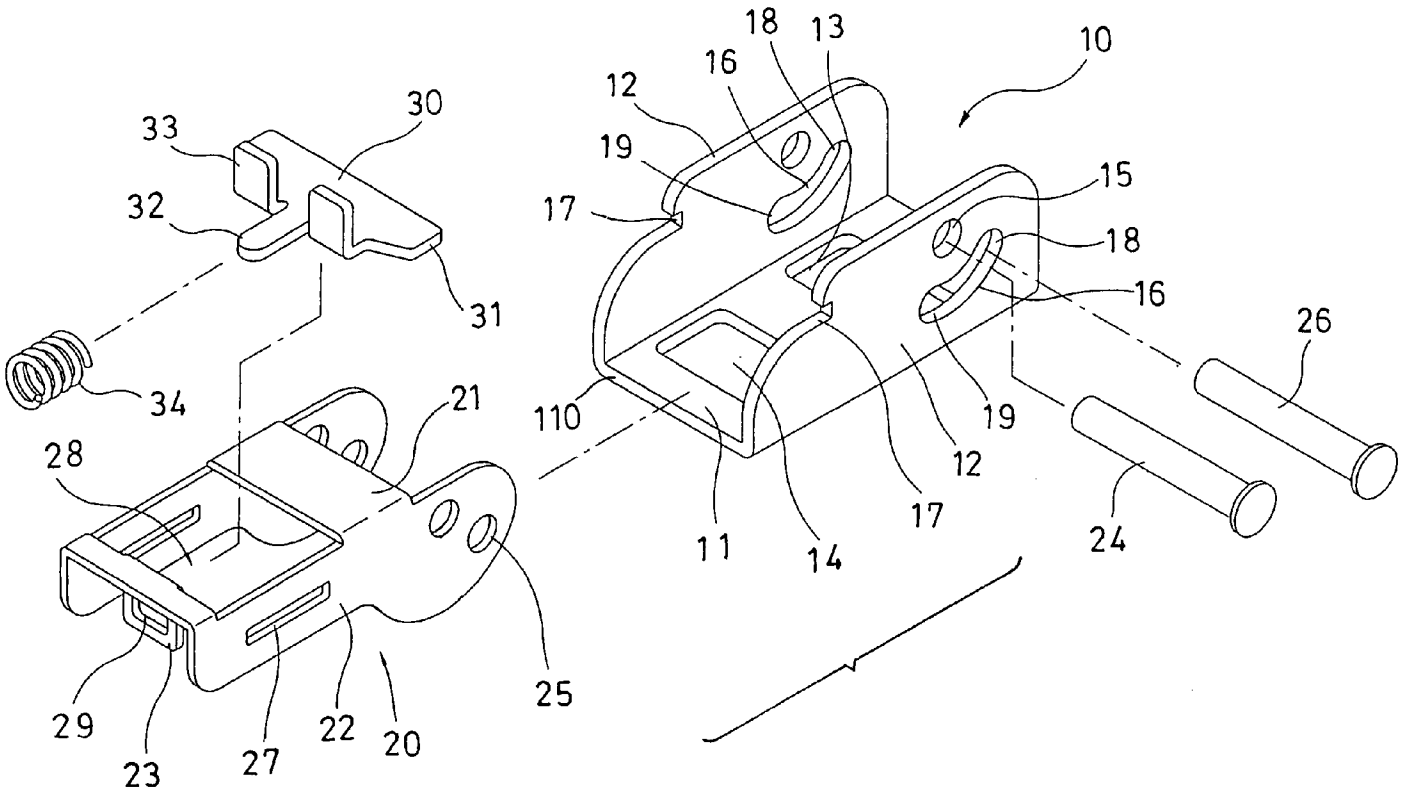
FIG. 1 is an exploded view of a connector device in accordance with the present invention.
Figure 2:
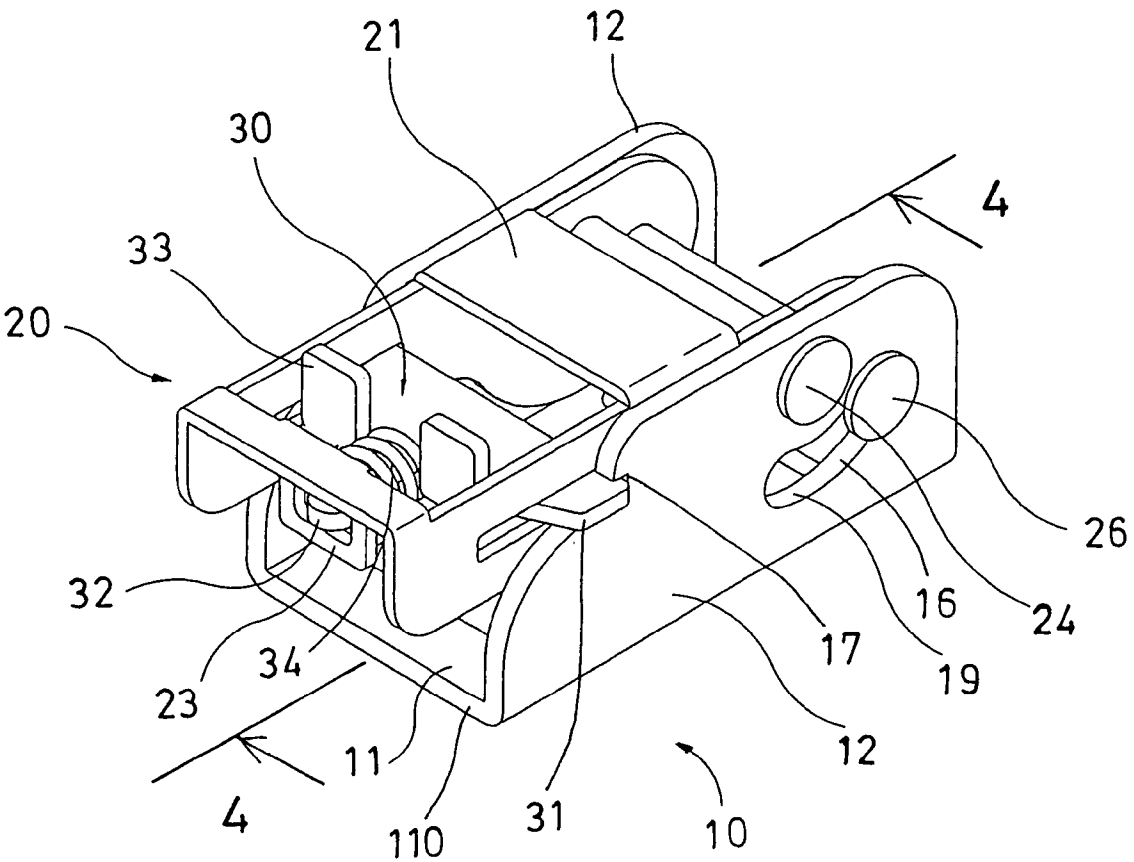
FIG. 2 is a perspective view of the connector device.
Figure 3:
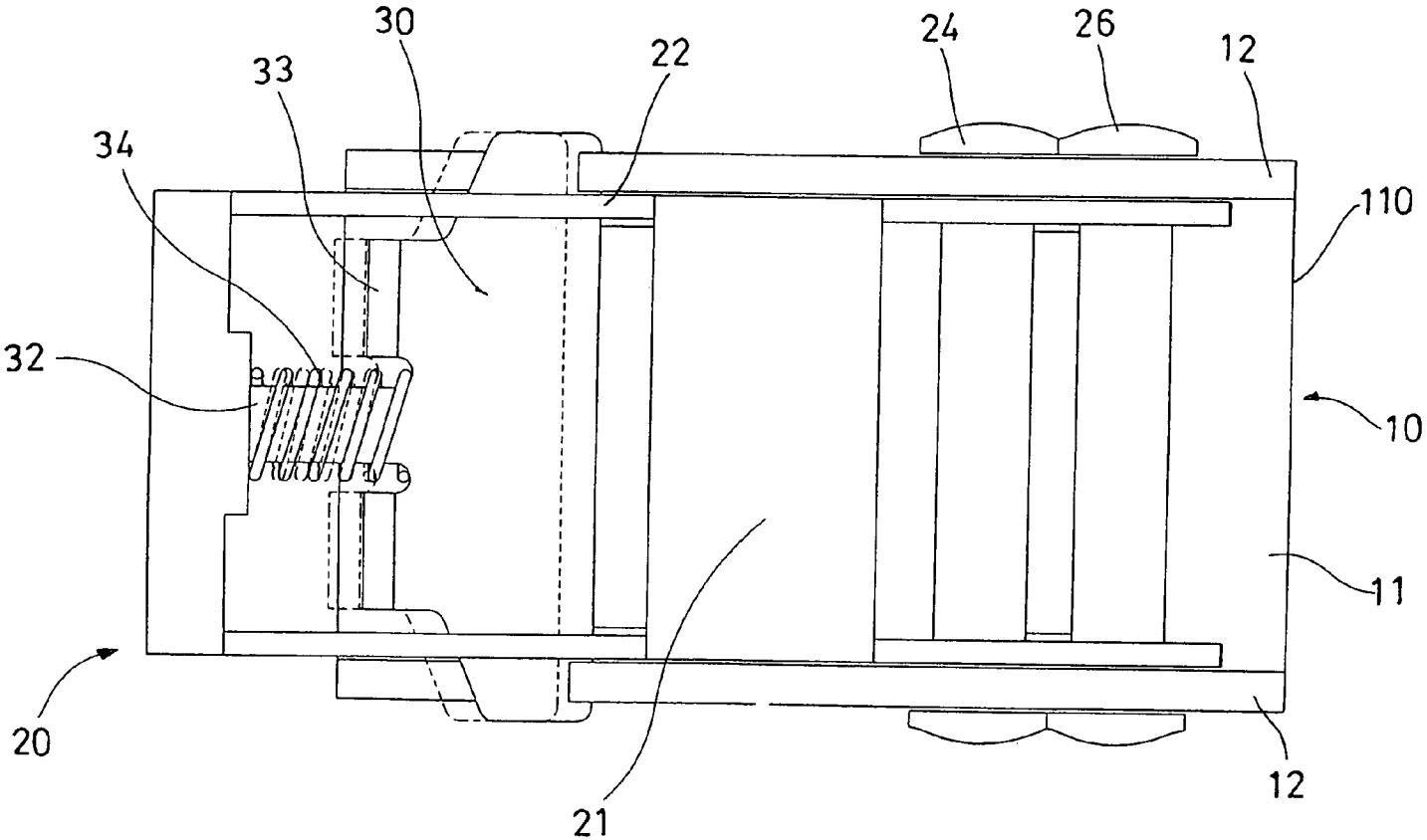
FIG. 3 is a top plan view of the connector device.

Referring to the drawings, and initially to FIGS. 1–4, a connector device in accordance with the present invention comprises a base 10 including a chamber 11 formed therein and defined between two side panels 12 and a bottom panel 110, and including one or more, such as two passages 13, 14 formed in the bottom panel 110 thereof. Each of the side panels 12 includes an orifice 15 formed therein and aligned with each other, to receive an axle 24 therein, and to allow the axle 24 to be straddled between the side panels 12.

The base 10 further includes two curved slots 16 formed in the side panels 12 respectively for slidably receiving a shaft 26 therein, and each of the two curved slots 16 includes a center of curvature located at the respective orifice 15 of the side panel 12, and includes two ends 18, 19, to limit the sliding movement of the shaft 26 relative to the base 10. The base 10 further includes one or more, such as two lock notches 17 formed therein, such as formed in the side panels 12 thereof respectively.

A connector frame 20 is received in the chamber 11 of the base 10, and is rotatably secured to the base 10 with the axle 24, and includes an upper plate 21, and two side plates 22 extended from and perpendicular to the upper plate 21. The frame 20 includes two holes 25 formed in the side plates 22 respectively, to receive or to attach the shaft 26 to the frame 20, such that the rotational movement of the frame 20 relative to the base 10 may also be limited by the sliding movement of the shaft 26 in the curved slots 16 of the base 10.

The frame 20 further includes two grooves 27 formed in the side plates 22 respectively, and includes an opening 28 formed in the upper plate 21, and includes an ear 23 extended downwardly from the upper plate 21 and having an aperture 29 formed therein.

A latch 30 includes two side catches 31 extended therefrom and slidably received in the grooves 27 of the frame 20 respectively, to guide and to limit the latch 30 to slide relative to the frame 20. The latch 30 may further include an extension 32 extended therefrom and slidably received through the aperture 29 of the ear 23 of the frame 20, to further stably guide the latch 30 to slide relative to the frame 20.

A spring 34 is engaged onto the extension 32 and engaged between the frame 20 and the latch 30, to bias the latch away from the ear 23, or to bias the catches 31 to engage into the lock notches 17 of the base 10 respectively (FIG. 2), and thus to lock the frame 20 to the base 10 at a locking position. The latch 30 includes one or more hand grips 33 extended therefrom, and extended outwardly through the opening 28 of the frame 20, for allowing the latch 30 to be easily moved relative to the frame 20, against the spring 34, by the users.

Figure 4:
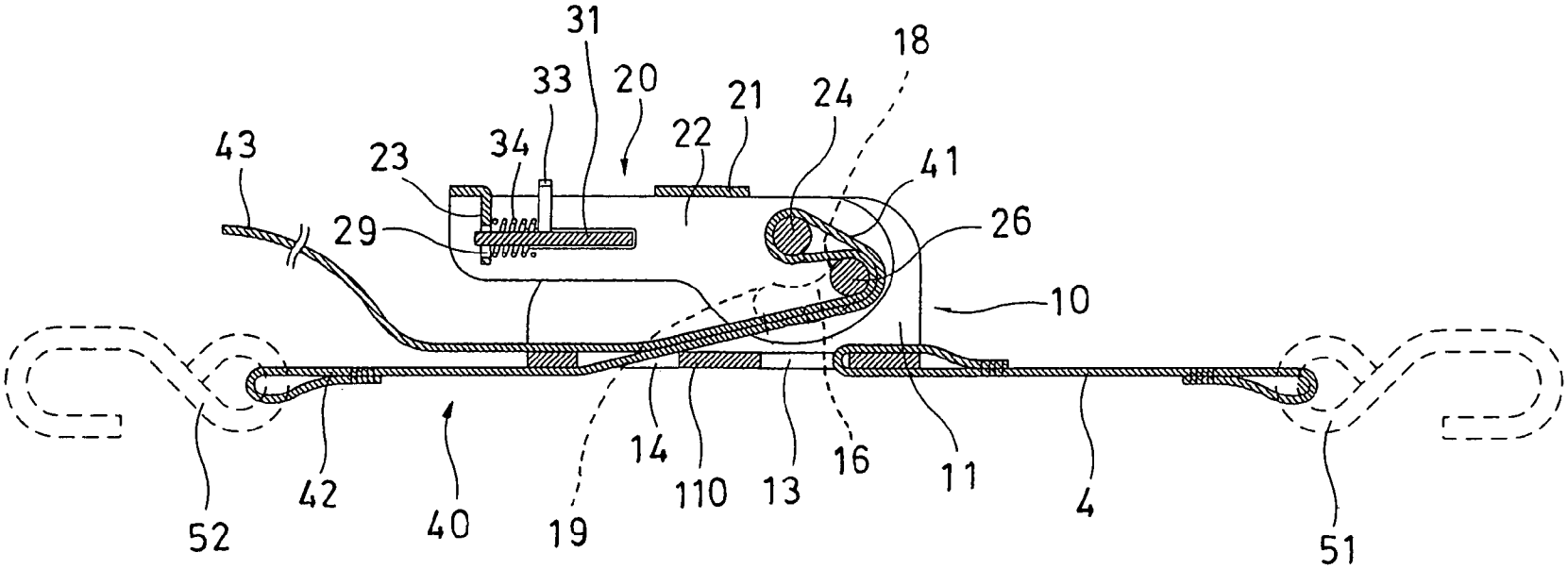
FIG. 4 is a cross sectional view taken along lines 4—4 of FIG. 2, having two straps attached to the connector device.
Figure 5:
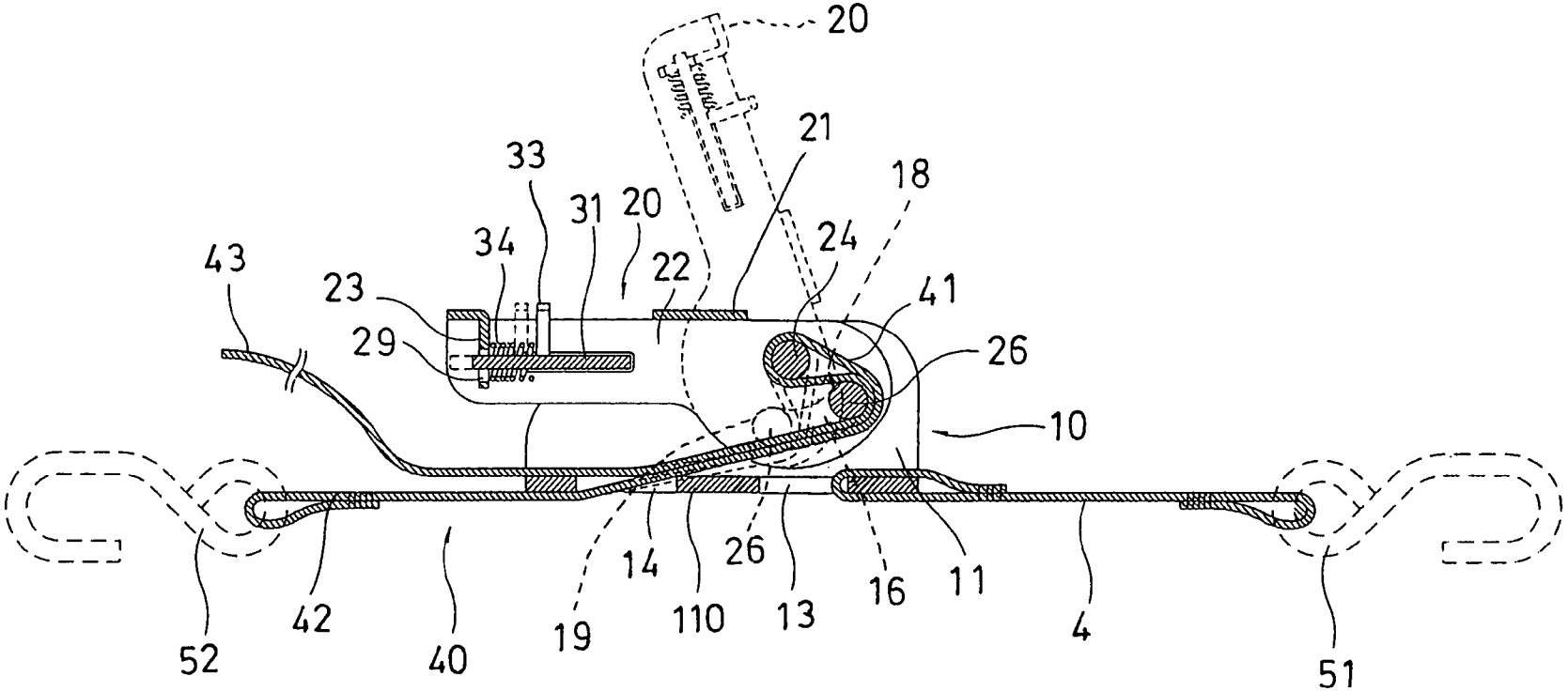
FIG. 5 is a cross sectional view similar to FIG. 4, illustrating the operation of the connector device.

As shown in FIGS. 4 and 5, a strap 4 may be engaged through the passage 13 of the base 10, and coupled or secured to the base 10, and may be coupled to a hook 51 or the like. Another strap 40 may have an intermediate portion or segment 41 engaged through the other passage 14 of the base 10, and engaged over the shaft 26 and engaged around the axle 24, and then engaged over the shaft 26 again, and may have one end 42 coupled to another hook 52 or the like, and may have the other end 43 extended out of the base 10 and the frame 20.

Figure 6:
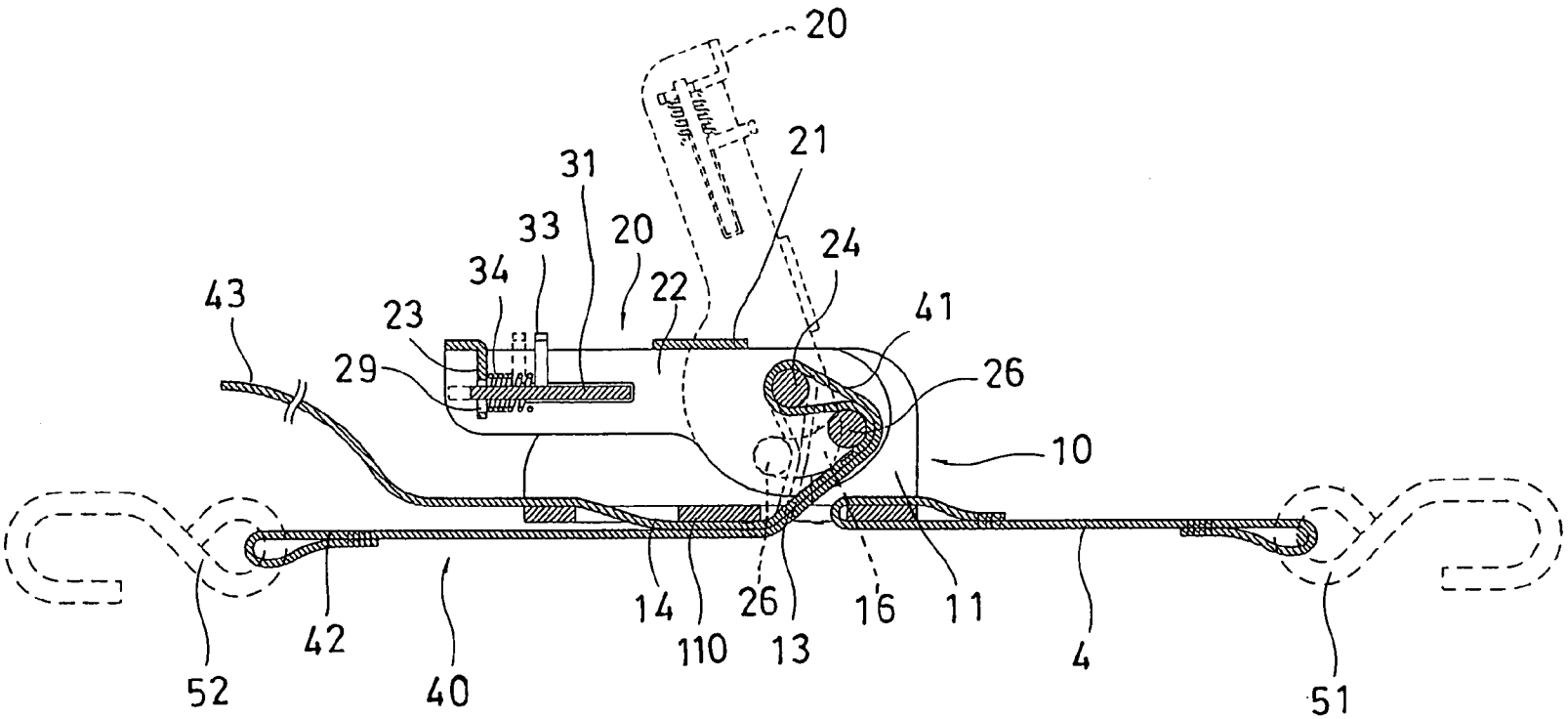
FIG. 6 is a cross sectional view similar to FIGS. 4 and 5, illustrating the other arrangement or application of the connector device.

Alternatively, as shown in FIG. 6, the other strap 40 may first be engaged through the passage 13 of the base 10, and then may have the intermediate segment 41 engaged over the shaft 26 and engaged around the axle 24, and then engaged over the shaft 26 again, and may then be engaged through the other passage 14 of the base, and may have the other end 43 extended out of the base 10 and the frame 20.

In operation, when the catches 31 of the latch 30 are released from the lock notches 17 of the base 10, the frame 20 may be rotated away from the base 10 to the released position as shown in dotted lines in FIG. 5, and the shaft 26 may also be moved toward the end portions 19 of the curved slots 16 of the base 10, such that the intermediate segment 41 of the strap 40 may be released by the shaft 26, and such that the strap 40 may be pulled or tightened relative to the base 10 or the other strap 4 at this moment, by such as pulling the other end 43 of the strap 40.

After the straps 4, 40 or the hooks 51, 52 have been tightened or forced or pulled toward each other by pulling the other end 43 of the strap 40, the frame 20 may then be forced toward the base 10, and may actuate or force the shaft 26 to move toward the other end 18 of the curved slots 16 of the base 10, and may force the shaft 26 to engage with and to further tighten the intermediate segment 41 of the strap 40. The frame 20 may then be locked to the base 10 at the locking position by the latch 30, as shown in solid lines in FIG. 5.

It is to be noted that, when the frame 20 is rotated away from or is released from the base 10 to the released position as shown in dotted lines in FIG. 5, the strap 40 may be easily and quickly pulled and tightened by pulling the other end 43 thereof, and then the frame 20 may be forced toward the base 10 to actuate the shaft 26 to tighten the intermediate segment 41 of the strap 40. The straps 4, 40 may thus be easily and quickly tightened and locked together by the relative movement between the base 10 and the frame 20 and by the latch 30.

Accordingly, the connector device in accordance with the present invention may be used for allowing two straps to be easily and quickly tightened together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A connector device comprising:

a base including a chamber formed therein and defined between two side panels and a bottom panel, each of said side panels including a curved slot formed therein, said base including at least one lock notch formed therein, an axle straddled between said side panels of said base, a first strap attached to said base, a connector frame received in said chamber of said base, and rotatably secured to said base with said axle, a shaft attached to said frame and slidably engaged in said curved slots of said side panels of said base, to guide and to limit a sliding movement of said shaft in said curved slots of said base, and to limit a rotational movement of said frame relative to said base, a latch slidably attached to said frame, and engageable with said at least one lock notch of said base, to selectively lock said frame to said base, and a second strap including an intermediate segment engaged over said shaft and engaged around said axle, and said shaft being engageable with said intermediate segment of said second strap, to force and to tighten said second strap when said frame is moved toward said base and locked to said base at a locking position with said latch, and said shaft releasing said intermediate segment of said second strap when said frame is rotated away from said base at a released position.

2. The connector device as claimed in claim 1, wherein said frame includes two side plates each having a groove formed therein, and said latch includes two side catches extended therefrom and slidably engaged through said grooves of said side plates of said frame, to guide said latch to slide relative to said frame.

3. The connector device as claimed in claim 1, wherein said frame includes an ear having an aperture formed therein, and said latch includes an extension extended therefrom and slidably engaged through said aperture of said ear of said frame, to guide said latch to slide relative to said frame.

4. The connector device as claimed in claim 1, wherein said frame includes an opening formed therein, and said latch includes at least one hand grip extended therefrom and extended outwardly through said opening of said frame, to allow said latch to be moved relative to said frame with said at least one hand grip.

5. The connector device as claimed in claim 1, wherein said frame includes a spring engaged between said frame and said latch for biasing said latch to engage with said at least one lock notch of said base.

6. The connector device as claimed in claim 1, wherein said base includes a passage formed therein, said first strap is engaged through said passage of said base and coupled to said base.

7. The connector device as claimed in claim 1, wherein said base includes a passage formed therein, said second strap is engaged through said passage of said base.

* * * * *